US012172682B2

(12) United States Patent
Linde

(10) Patent No.: US 12,172,682 B2
(45) Date of Patent: Dec. 24, 2024

(54) RAILWAY WAGON FOR TRANSPORTATION OF SEMI-TRAILERS AND THE LIKE

(71) Applicant: Helrom GmbH, Frankfurt am Main (DE)

(72) Inventor: Peter Linde, Limhamn (SE)

(73) Assignee: Helrom GmbH, Frankfurt am Main (DE)

( * ) Notice: Subject to any disclaimer, the term of this patent is extended or adjusted under 35 U.S.C. 154(b) by 811 days.

(21) Appl. No.: 17/285,588

(22) PCT Filed: Oct. 24, 2019

(86) PCT No.: PCT/EP2019/079091
§ 371 (c)(1),
(2) Date: Apr. 15, 2021

(87) PCT Pub. No.: WO2020/084081
PCT Pub. Date: Apr. 30, 2020

(65) Prior Publication Data

US 2021/0394804 A1 Dec. 23, 2021

(30) Foreign Application Priority Data

Oct. 24, 2018 (EP) ..... 18202352

(51) Int. Cl.
*B61D 3/04* (2006.01)
*B61D 3/18* (2006.01)
*B61D 47/00* (2006.01)

(52) U.S. Cl.
CPC ..... *B61D 47/005* (2013.01); *B61D 3/04* (2013.01); *B61D 3/184* (2013.01)

(58) Field of Classification Search
CPC ..... B61D 3/04; B61D 3/184; B61D 47/005
See application file for complete search history.

(56) References Cited

U.S. PATENT DOCUMENTS

| | | | | |
|---|---|---|---|---|
| 732,055 | A | 6/1903 | Donavan | |
| 3,576,167 | A * | 4/1971 | Macomber | B61D 45/005 410/58 |
| 5,567,107 | A | 10/1996 | Bruno et al. | |
| 7,650,844 | B2 | 1/2010 | Eriksson | |
| 8,505,948 | B2 | 8/2013 | Granlind | |
| 8,667,902 | B2 | 3/2014 | Linde | |
| 2011/0280696 | A1 | 11/2011 | Kun et al. | |

FOREIGN PATENT DOCUMENTS

| | | | |
|---|---|---|---|
| CA | 3004477 | A1 | 6/2017 |
| CN | 101475103 | A | 7/2009 |
| CN | 102060202 | A | 5/2011 |
| CN | 102395501 | A | 3/2012 |

(Continued)

*Primary Examiner* — Robert J McCarry, Jr.
(74) *Attorney, Agent, or Firm* — Renner, Otto, Boisselle & Sklar, LLP

(57) ABSTRACT

A railway wagon for semitrailers and the like may include a first bogie, a second bogie, and a carrying section therebetween. An elongated channel configured to receive conduits for air, hydraulics and/or electronics may extend between the two bogies. The media channel may be lowered in a mechanical way when the carrying section is turned out to a loading/unloading position.

20 Claims, 7 Drawing Sheets

(56) References Cited

FOREIGN PATENT DOCUMENTS

| | | | | | |
|---|---|---|---|---|---|
| CN | 103118899 | A | | 5/2013 | |
| CN | 103243918 | A | | 8/2013 | |
| CN | 104527668 | A | | 4/2015 | |
| CN | 204488797 | U | | 7/2015 | |
| CN | 105584492 | A | | 5/2016 | |
| CN | 105016022 | B | | 3/2017 | |
| CZ | 200541 | A3 | | 5/2006 | |
| DE | 1961193 | | | 6/1971 | |
| EP | 1348603 | | | 10/2003 | |
| EP | 2399789 | | | 12/2011 | |
| ES | 287212 | U | | 12/1985 | |
| RU | 2700100 | C1 | | 9/2019 | |
| SE | 527117 | C2 | | 12/2005 | |
| SU | 1689165 | A1 | | 11/1991 | |
| WO | 0198128 | | | 12/2001 | |
| WO | 2006031178 | A1 | | 3/2006 | |
| WO | 2010120236 | | | 10/2010 | |
| WO | WO-2010120236 | A1 | * | 10/2010 | ..... B61D 3/04 |
| WO | 2017097373 | | | 6/2017 | |

* cited by examiner

RAILWAY WAGON FOR TRANSPORTATION OF SEMI-TRAILERS AND THE LIKE

Cross-reference to related applications

This application is a US PCT National Stage Entry of International Application No. PCT/EP2019/079091 filed on Oct. 24, 2019, which claims priority to EP patent Application No. 18202352.3 filed on Oct. 24, 2018, the entire disclosures of which are hereby incorporated by reference.

TECHNICAL FIELD

The present invention relates to a railway wagon for transportation of semitrailers and the like.

BACKGROUND

It is well known to provide railway wagons for receiving and carrying semitrailers. By placing a semitrailer normally intended for road transport on a railway wagon, a more efficient and environmentally friendly transportation is achieved compared to road transport. The railway is normally used for long distances. Examples of railway wagons for transport of semitrailers are given in WO2010/120236A1.

To load and unload a semitrailer in a railway wagon system of this kind, a load-carrying section of the railway wagon is turned out from and back to the railway wagon. To assist in the turning of the load-carrying section, it is common to use a beam which can be moved out from the railway wagon. At an outer end of the beam, there is provided a ground support which often-times has the shape of a telescopic supporting member. The support is moved by means of a vertically operated jack which is configured to lower the support until it rests on the ground in order to support the beam as the load-carrying section is turned out from or back to the railway wagon. Even though such a vertically operated jack works well in many circumstances, there is a risk that it will break. This might happen if the structure is subjected to movements, which may happen when the load from the ground support is not vertical; for instance if the support is placed on uneven ground.

Known railway wagons of the type described above oftentimes have a lot of cables and conduits running along its platform. During the turning movement of the carrying section, there is a risk that these cables and conduits get stuck or damaged.

From the above, it is understood that there is room for improvements of railway wagon systems.

SUMMARY

An object of the present invention is to solve or at least mitigate the problems related to prior-art structures. This object has now been achieved by the technique set forth in appended independent claim 1; preferred embodiments being defined in the related dependent claims.

In one aspect, there is provided a railway wagon configured to carry a semitrailer or the like. The railway wagon comprises a first bogie, a second bogie and a carrying section therebetween. The carrying section is movable between a first position in which it extends between the two bogies, and a second position in which the carrying section is turned out from the railway wagon for loading and unloading of a semitrailer. The railway wagon further comprises a channel for conduits extending between the first bogie and the second bogie. The channel is configured to be automatically lowered in a mechanical way when the carrying section is turned out to the second position. This railway wagon structure is advantageous since the different kinds of conduits—such as air supply pipes, hydraulic oil supply tubes, and power supply cables—can be kept safely together in the channel which is also referred to as a media channel. The conduits are received in the media channel and protected therein during railway transportation and during loading and unloading of semitrailers, when the carrying section is turned out and turned back in relation to the railway wagon.

Preferably, the channel is arranged beneath the carrying section which means that the turning movement of the same can be performed in a safe manner.

In an embodiment, one end portion of the channel is received moveable on a bar having a sloping part. Preferably, the channel has a roller received on the bar. These features contributes to a safe use of the media channel.

In another aspect, there is provided a railway wagon beam assembly which is arranged to be moved out from and back to the railway wagon. The beam assembly may include an actuator, preferably a hydraulic cylinder, arranged to lower and raise a leg placed at an outer or outward end of the beam assembly. Preferably, the leg has a foot at its free end. The actuator is preferably arranged substantially in parallel with a main extension of the beam assembly. Thanks to this beam structure, loads that are not entirely vertical can be taken. Furthermore, the risk of breaking the hydraulic cylinder is reduced.

The improved beam assembly is adapted to be mounted to a railway wagon which is configured to carry semitrailers and the like and which has a first bogie, a second bogie and a carrying section therebetween. When a semitrailer is to be loaded onto the railway wagon, the beam assembly is moved out from the wagon to an active position, in which it guides the front portion of the carrying section being turned out to its loading position. The beam assembly is moved back to the wagon and the semitrailer is driven onto the lowered, sloping carrying section which is raised after loading. Then the beam assembly is moved out again and guides the front portion of the raised carrying section (with the semitrailer thereon) back to the wagon position. Finally, the beam assembly is moved back to the wagon which is now ready for railway transportation.

Subject to the present disclosure is also a railway wagon of the above type which is provided with an improved beam assembly according to the aspect above.

The beam assembly may be provided with pivots and links which serve to achieve secure ground support of the beam in its active position moved out from the wagon. This system of pivots and links is arranged at the free end of the beam assembly and it is connected to and configured to move the leg of the beam.

The railway wagon may have a slide of a king pin locking system arranged moveable by means of two cylinders. The two cylinders are connected to a reservoir via a spring-loaded valve to act as dampers.

Further objects and advantages of the present invention and related embodiments will appear from the following detailed description.

BRIEF DESCRIPTION OF THE DRAWINGS

Embodiments of the present invention will be described further below by way of example and with reference to the accompanying drawings, in which.

DETAILED DESCRIPTION OF EMBODIMENTS

Figure 1:
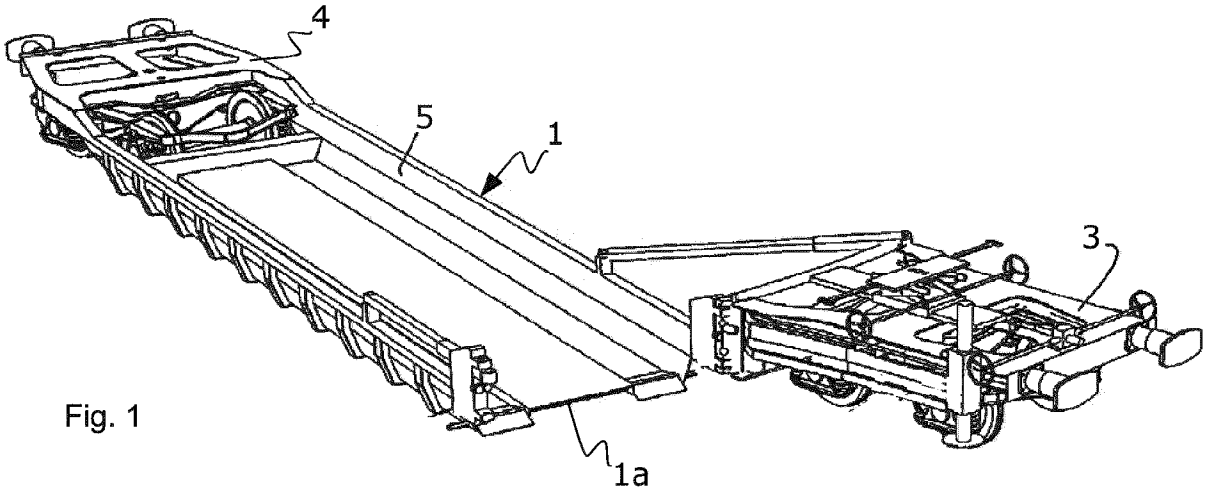
FIG. 1 is a perspective view of a railway wagon in a position for receiving a semitrailer.
Figure 2:
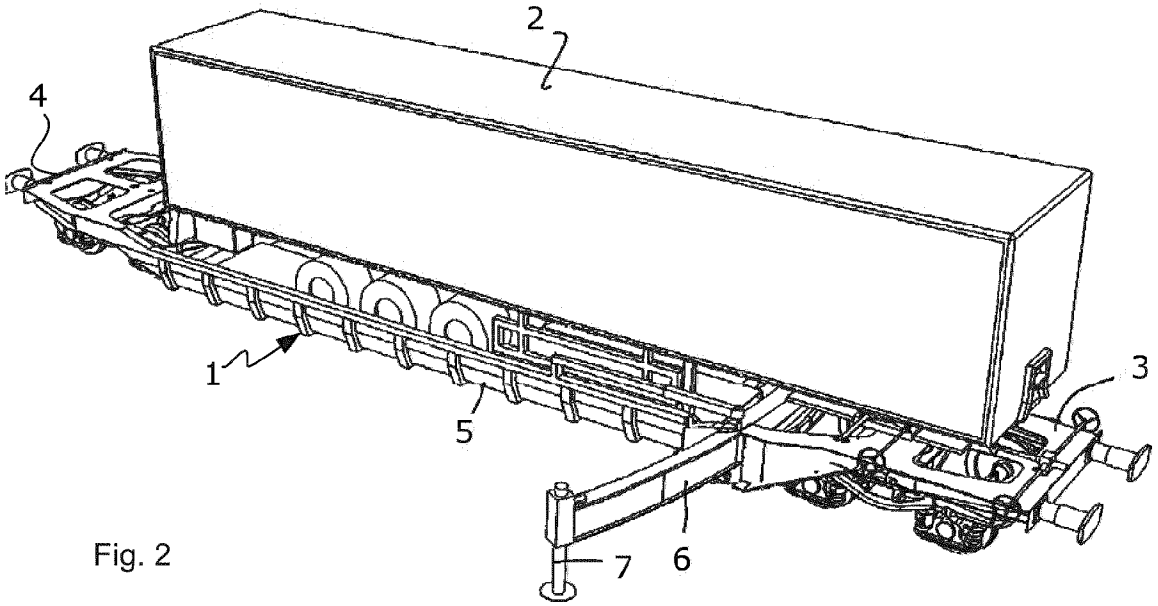
FIG. 2 is a perspective view of the railway wagon of FIG. 1 with a semitrailer loaded onto the railway wagon.

In the example of FIGS. 1 and 2, a railway wagon 1 is shown which is adapted for receiving a semitrailer 2. The railway wagon 1 comprises a first bogie 3 and a second bogie 4, placed at opposite ends of a load-carrying section 5. As shown in FIG. 1, the carrying section 5 may be turned outwards and lowered to make it possible to drive the semitrailer 2 onto the section 5. The carrying section 5 is pivotally connected to the second bogie 4 by means of pivot means (not shown) which make it possible to turn or "swing" the section 5 to the position shown in FIG. 1. When the semitrailer 2 has been driven onto the carrying section 5, this section 5 is raised and turned back with the semitrailer 2 carried thereon to the position shown in FIG. 2.

For turning the carrying section 5 in and out, a beam 6 is moved out from the first bogie 3 of the railway wagon 1. The beam 6 is supported by a telescopic leg 7, in the form of a hydraulic cylinder, at an outer end. The hydraulic cylinder is placed and works in a vertical direction. After the carrying section 5 has been turned out, the beam 6 is moved hack to the first bogie 3, in order for allowing a semitrailer 2 to be brought onto the carrying section 5. Then the beam 6 is moved back out again, to turn the load-carrying section 5 back in line with the first and second bogies 3, 4. In the position where the carrying section 5 has been turned out, it is lowered to receive the semitrailer 2 and then raised again when it is to be turned back. The railway wagon 1 is provided with means (not shown) for lowering and raising the front portion 1*a* of the carrying section 5.

In the following, the position shown in FIG. 2 is also referred to as the first or transportation position whereas the position shown in FIG. 1 is referred to as the second position for loading or unloading of a semitrailer 2 or the like. In the second position of FIG. 1, the carrying section 5 serves as a ramp for the semitrailer 2 to be driven onto the carrying section 5 to perform transportation by the railway wagon 1, or driven down from the carrying section 5 when the destination has been reached.

Figure 3:
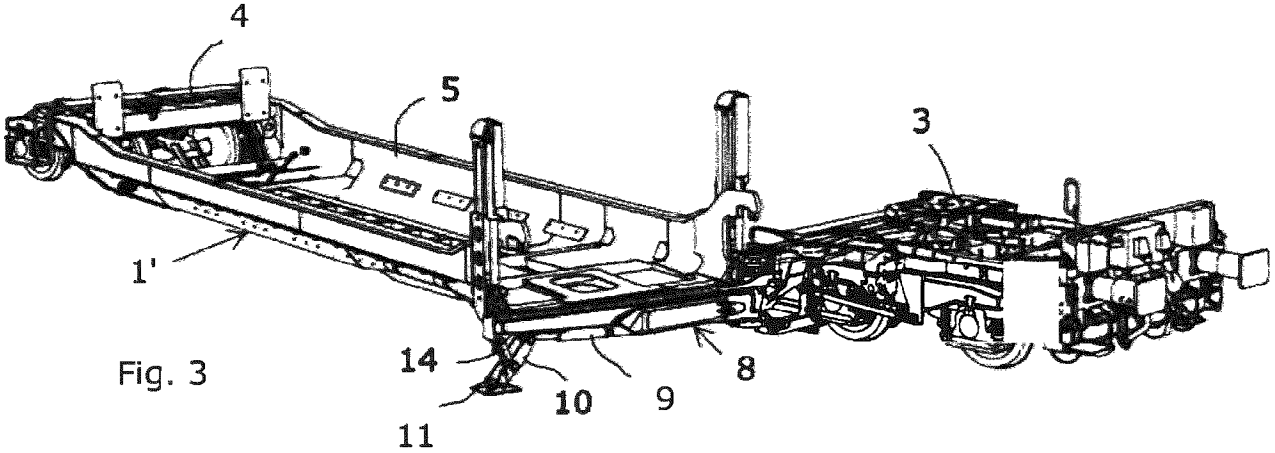
FIG. 3 is a perspective view of a railway wagon according to an embodiment of the present invention.
Figure 4:
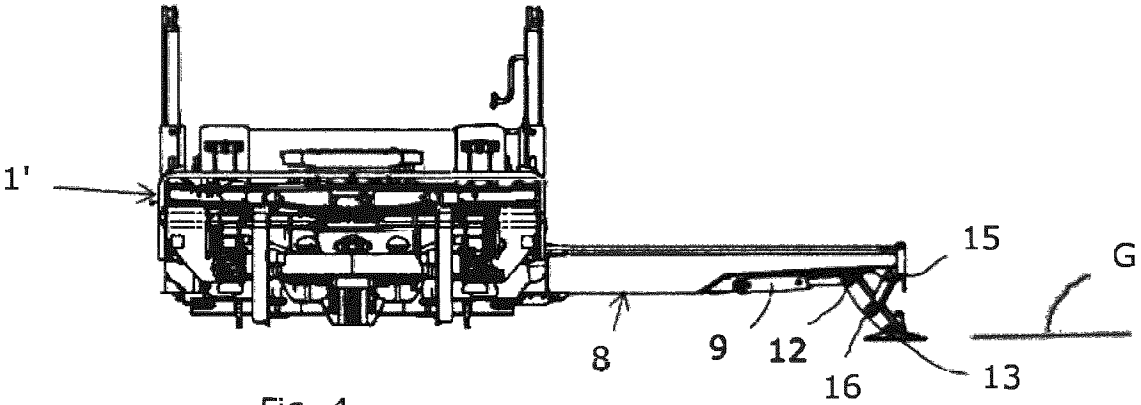
FIG. 4 is an end view of the railway wagon of FIG. 3 with a beam assembly moved out from the railway wagon.

In FIGS. 3 and 4, there is shown a railway wagon 1' which has the same basic structure as the railway wagon 1 of FIGS. 1-2 but which is provided with a modified beam assembly 8 arranged to be moved out from and in to the first bogie 3 when the load-carrying section 5 is to be turned out or back. The improved beam assembly 8 is mounted to the railway wagon 1' and it comprises an actuator, preferably a hydraulic cylinder 9, which extends substantially in parallel to the axis of the beam. By this placement of the hydraulic cylinder 9, this cylinder is in parallel with the main extension of the beam assembly 8.

Figure 5:
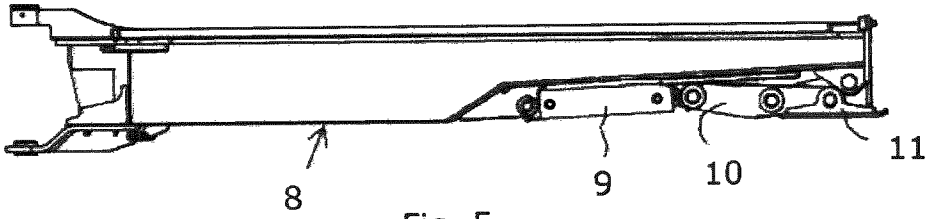
FIG. 5 shows the beam assembly separately in its idle position.
Figure 6:
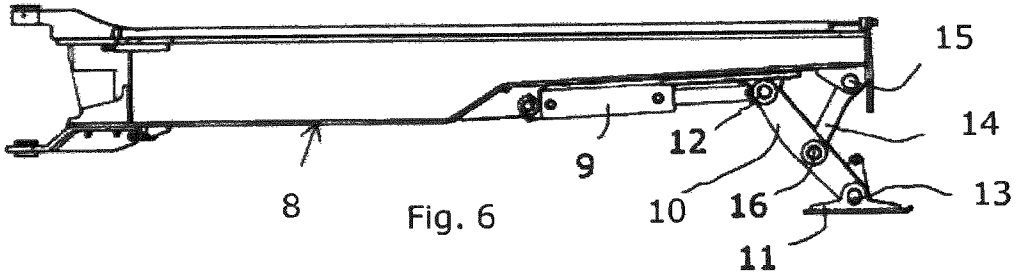
FIG. 6 shows the beam assembly of FIG. 5 in its ground supporting position.
Figure 7:
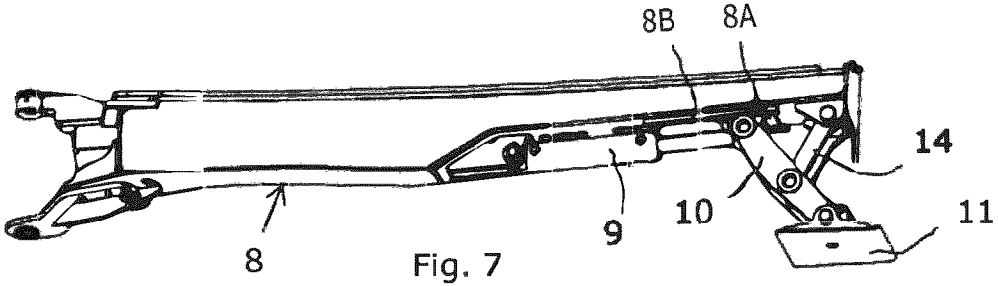
FIG. 7 shows the beam assembly of FIG. 6 in a slightly tilted view.

With reference to FIGS. 5-7, it is shown that an outer end of a piston of the hydraulic cylinder 9 is connected to a first end of a leg 10. A foot 11 is placed at a second end of the leg 10. The hydraulic cylinder 9 is connected to the leg 10 by means of a first pivot 12, and the foot 11 is connected to the leg 10 by means of a second pivot 13. A link 14 is placed between the beam body and the leg 10. As shown, the link 14 is connected to an outer end of the beam assembly 8 by means of a third pivot 15 and to the leg 10 by means of a fourth pivot 16. The link 14 is connected to the leg 10 in a position between the first and second ends of the leg 10.

The end of the leg 10 at the hydraulic cylinder 9 is placed on a sliding member 8A which is connected to a rail 8B mounted to the beam assembly 8. The sliding member 8A is free to move along the rail 8B and thereby along the beam assembly 8. However, the sliding member 8A is not free to move in a vertical direction and, thus, the hydraulic cylinder 9 is kept in parallel with a main extension of the beam assembly 8.

In the shown embodiment, the leg 10 is formed of two parallel plates. However, a person skilled in the art realizes that the leg 10 can have different designs.

When the piston of the hydraulic cylinder 9 is fully retracted, the leg 10 has a horizontal position at the beam assembly 8, as shown in FIG. 5. In this idle position, the beam assembly 8 represents a compact unit without any parts protruding downwards from the beam body. This is an advantage when the beam assembly 8 is moved between the idle position at the wagon 1' and the active position transverse to the wagon 1'.

To lower the leg 10 in the active position of the beam assembly 8, the piston of the hydraulic cylinder 9 is pushed out. Due to the link 14 placed between the beam body and the leg 10, this leg will be turned downwardly. The leg 10 will be lowered until the foot 11 hits the ground G, as shown in FIG. 6 (see also FIGS. 3-4). As the foot 11 is connected to the leg 10 by means of the second pivot 13, the foot 11 can be securely placed also on a sloping ground.

The leg 10 and link 14 form a kind of scissor linkage which can take up forces in several directions. As the hydraulic cylinder 9 is horizontally placed at the beam assembly 8, it has a well defined position and working area, and it will not be exposed to any skewed forces irrespectively of the direction of forces on the foot 11 from the ground G.

Briefly described, the railway wagon 1' provided with the improved beam assembly 8 operates in the following manner. When a semitrailer 2 is to be loaded onto the railway wagon 1', the beam assembly 8 is moved out from the wagon 1' to an active position, in which it guides the front portion la of the carrying section 5 being turned out to its loading position. The beam assembly 8 is moved back to the wagon 1' and the semitrailer 2 is driven onto the lowered, sloping carrying section 5 which is raised after loading. Then the beam assembly 8 is moved out again to the position transverse to the longitudinal axis of the wagon 1' and guides the front portion 1*a* of the raised load-carrying section 5 (with the semitrailer thereon) back to wagon position. Finally, the beam assembly 8 is moved back to the wagon 1' which is ready for railway transportation. The railway wagon 1' is provided with means (not shown) for lowering and raising the front portion 1*a* of the carrying section 5.

Figure 9:
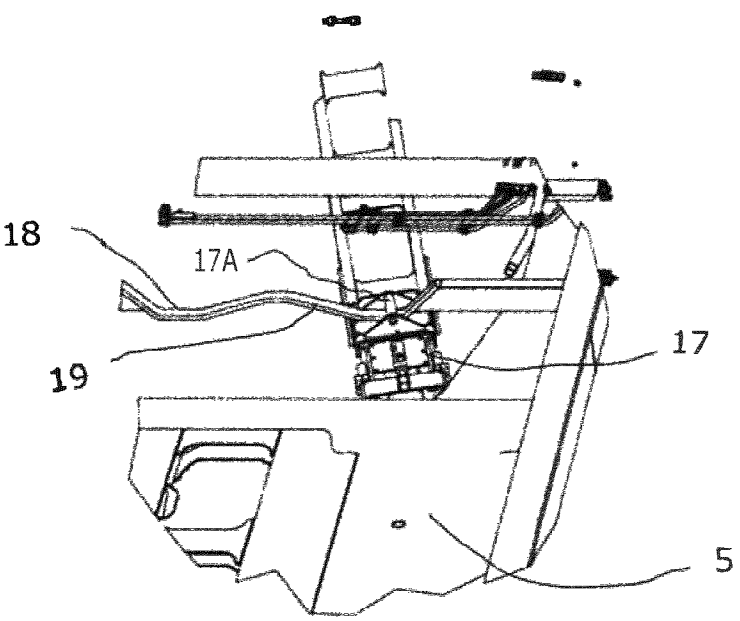
FIG. 9 is an enlarged view of a portion of FIG. 8 encircled at A.
Figure 8:
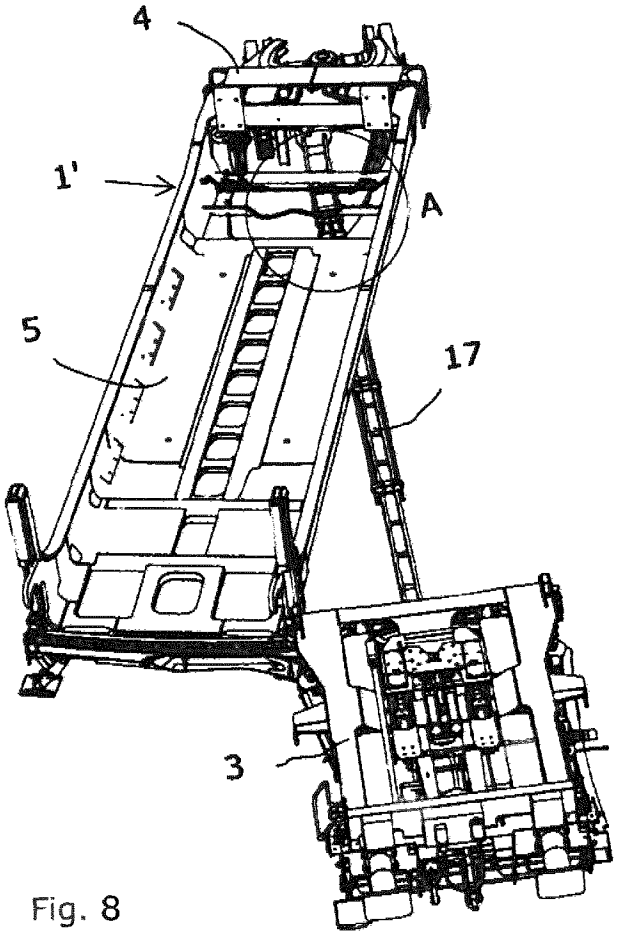
FIG. 8 is a perspective view of a railway wagon illustrating further components of the railway wagon.

The railway wagon 1' of FIGS. 8-9 includes conduits for hydraulic, air and electronics (not shown) extending from the first bogie 3 to the second bogie 4 at opposite ends of the railway wagon 1'. An elongated channel 17 is provided for these conduits. Hence, the conduits are safely kept together in the channel 17. As shown in FIG. 8, the channel 17 extends between the first bogie 3 and the second bogie 4. One end portion of the channel 17 is pivotally connected to the second bogie 4 by means of pivot means (not shown). When the carrying section 5 is turned out from the wagon 1', the channel 17 has to be lowered when the carrying section 5 is lowered for loading and unloading of a semitrailer 2.

As shown in FIG. 9, the channel 17—which is also referred to as a media channel for receiving conduits—is supported on a bar 18 at the second bogie 4. The channel 17 has a roller 17A adapted to follow the bar 18. Furthermore, the bar 18 has a sloping part 19 being at the highest point in the position when the carrying section 5 is turned back onto the railway wagon 1'. When the carrying section 5 is turned out from the railway wagon 1', the roller 17A of the channel 17 will go downwards along the sloping rail part 19, thereby lowering the channel 17. Thus, there is a mechanical lowering of the media channel 17, removing the need of any hydraulic cylinder or similar means for the lowering, and making the movements more certain as the channel 17 is automatically lowered.

Figure 10:
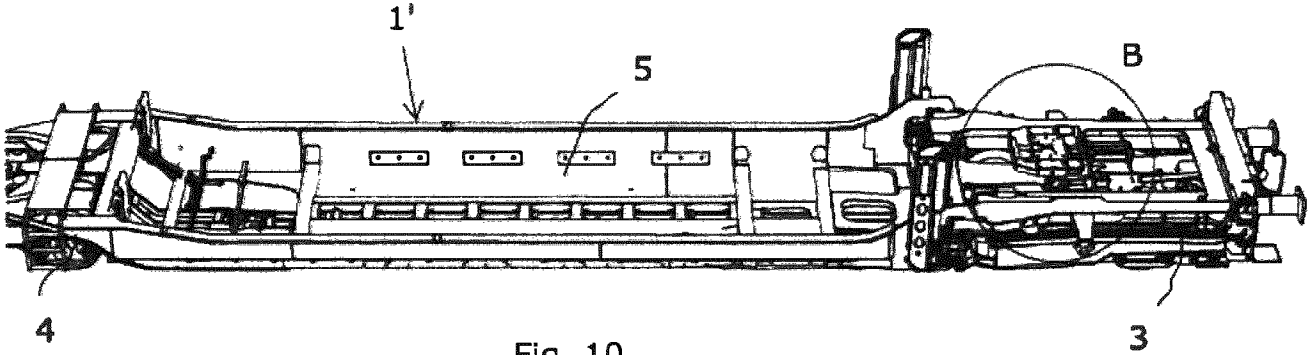
FIG. 10 is a perspective view of a railway wagon illustrating still further components of the railway wagon.
Figure 12:
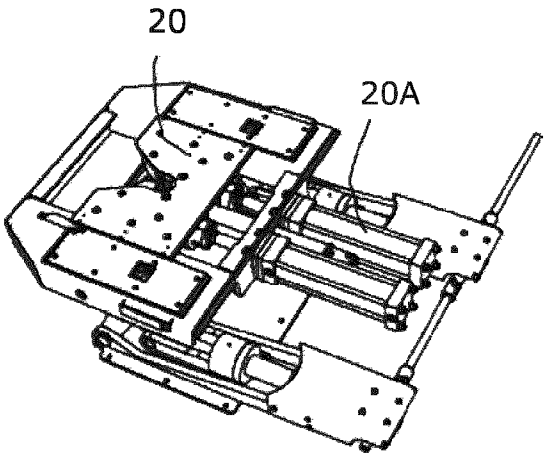
FIG. 12 is a perspective view of a part of the railway wagon of FIGS. 10-11.
Figure 11:
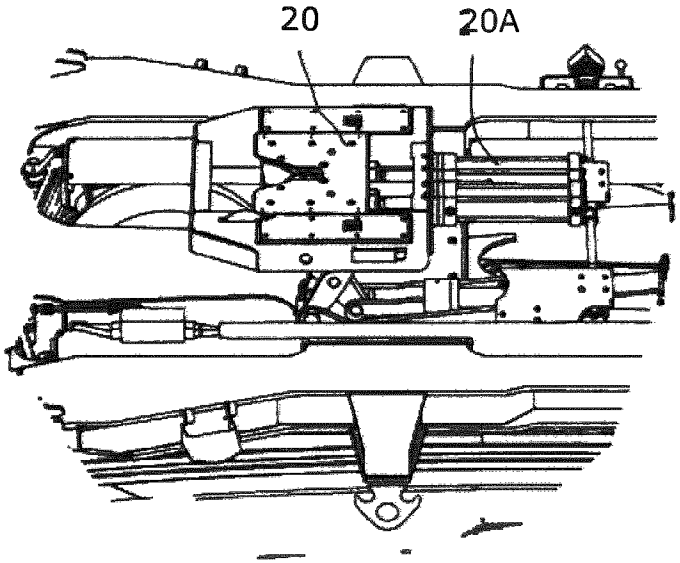
FIG. 11 is an enlarged view of a portion of FIG. 9 encircled at B.
Figure 13:
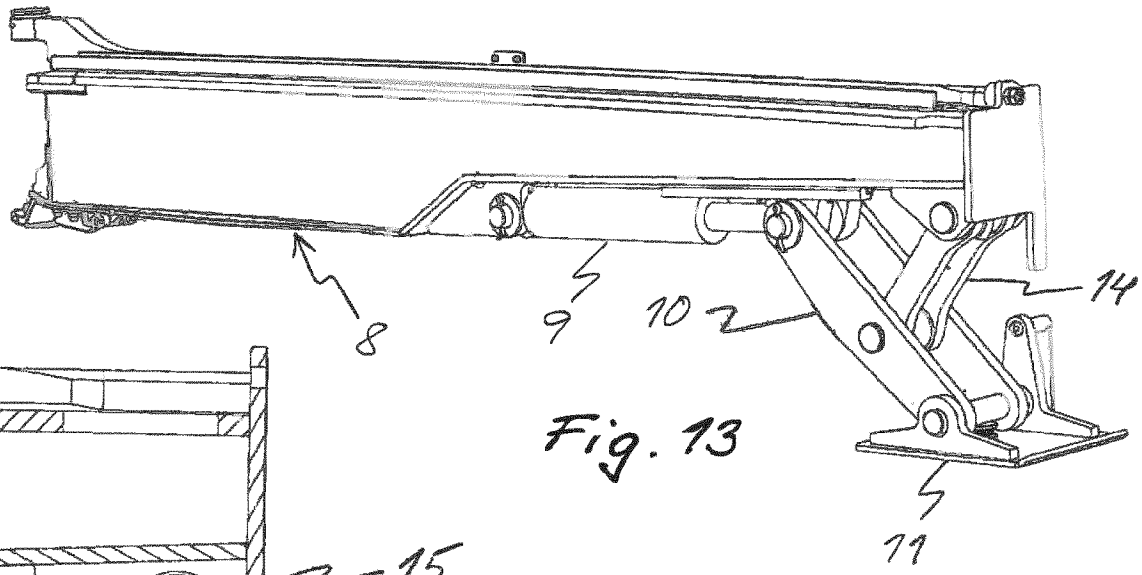
FIG. 13 is a perspective view of a slightly modified beam assembly.

The railway wagon 1' of FIGS. 10-12 includes a system for locking a king pin of the semitrailer 2 when the semitrailer 2 is in position on the railway wagon 1'. This system comprises a slide 20 which is moveable to catch the king pin (not shown). The slide 20 is moved back and forth in a longitudinal direction along the center axis of the wagon by means of two hydraulic cylinders 20A. When the semitrailer 2 has been loaded upon the railway wagon 1' and the train is moving, the cylinders 20A act as dampers in case the railway wagon 1' would experience any bumps, for instance if railway wagons run in to each other.

This dampening effect is achieved in that a reservoir (not shown) is provided for the oil of the cylinders 21 and that a spring-loaded valve is provided (not shown), which valve at a certain predetermined pressure will let oil through from the cylinders 21 to the reservoir. When the cylinders 21 have moved a certain distance, for instance 50 mm, the reservoir will be full and the cylinders 21 will not move any further. Before reaching the end position there has been a certain degree of dampening.

Figure 15:
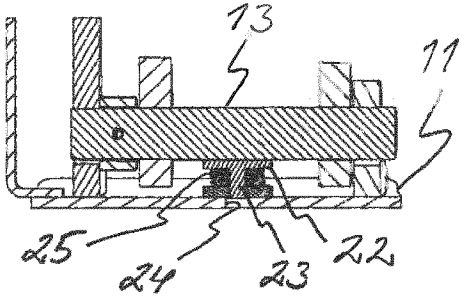
FIG. 15 is a section taken along the line XV-XV in FIG. 14.
Figure 14:
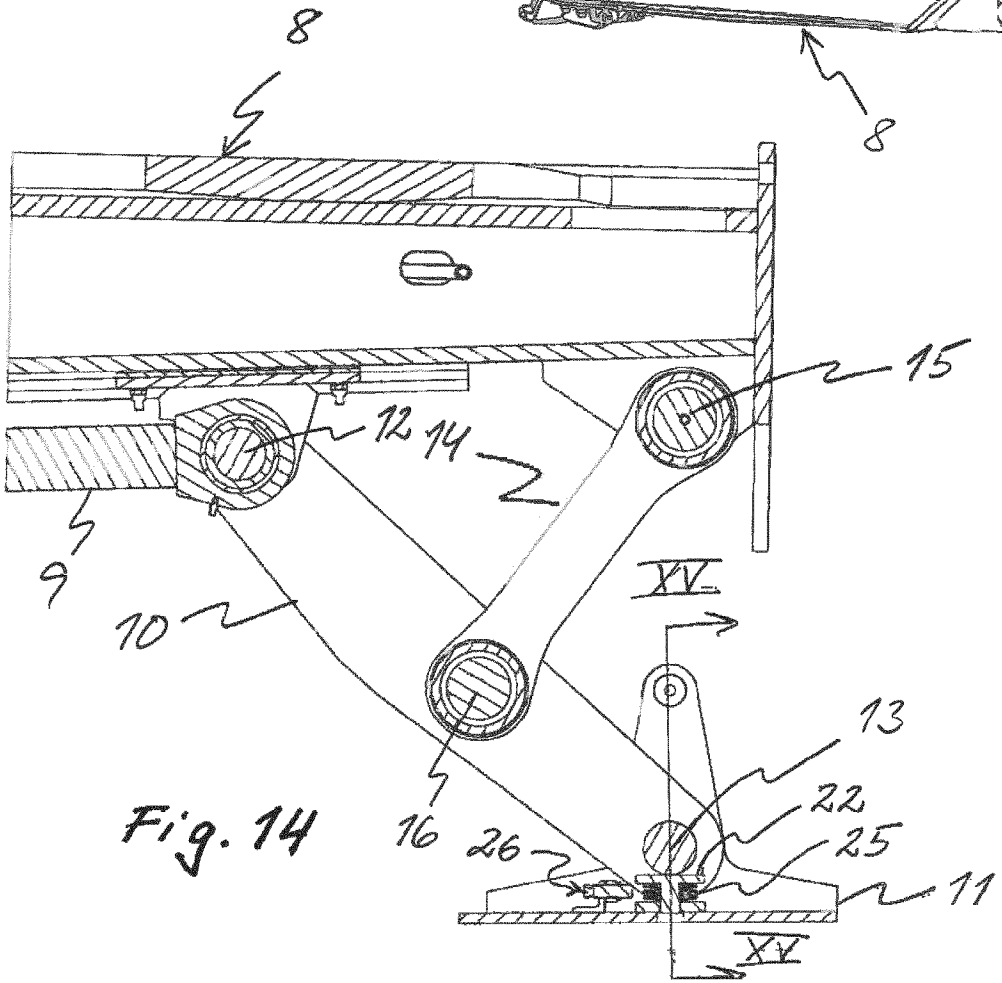
FIG. 14 is a partial section of the beam assembly of FIG. 13.
Figure 17:
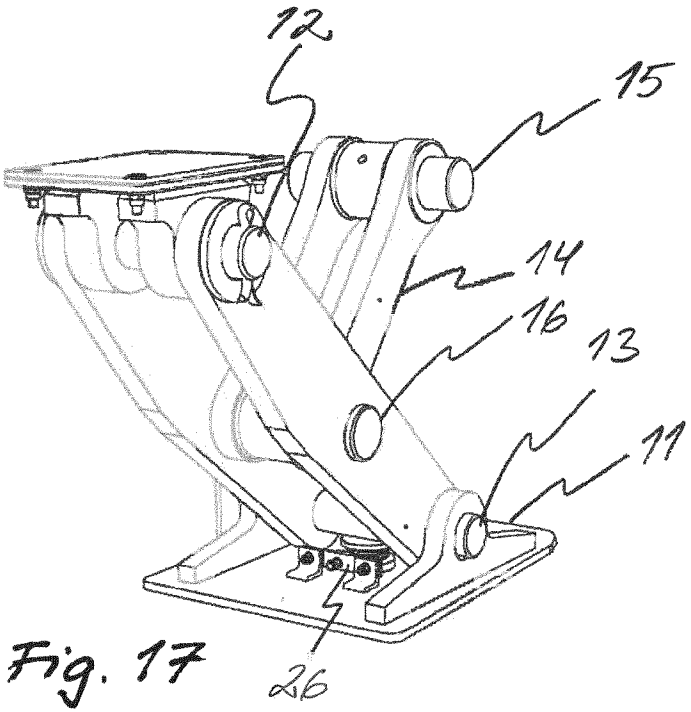
FIGS. 16-17 are perspective views of a supporting leg of the beam assembly shown in FIG. 13.
Figure 19:
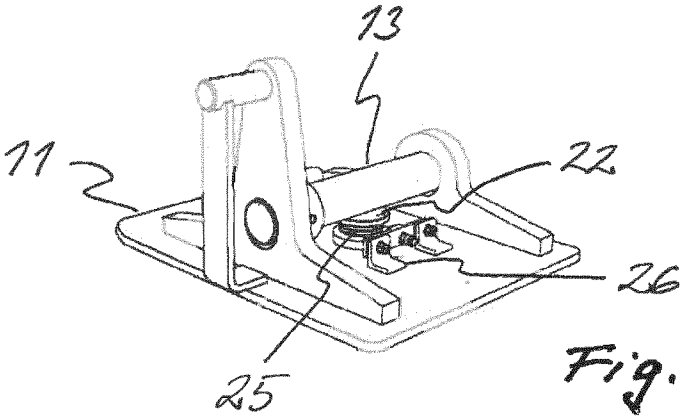
FIGS. 18-19 are perspective views of a foot of the supporting leg of FIGS. 16-17.
Figure 16:
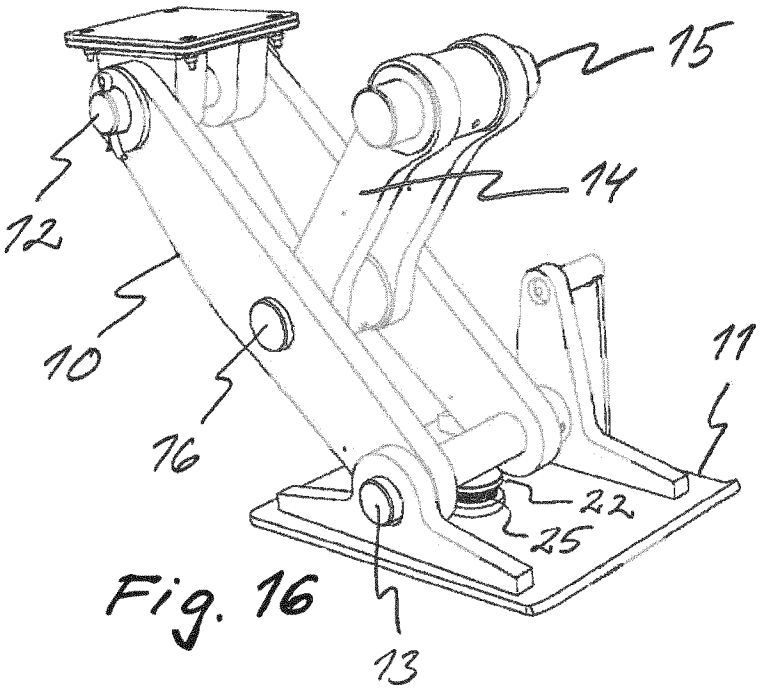
Figure 18:
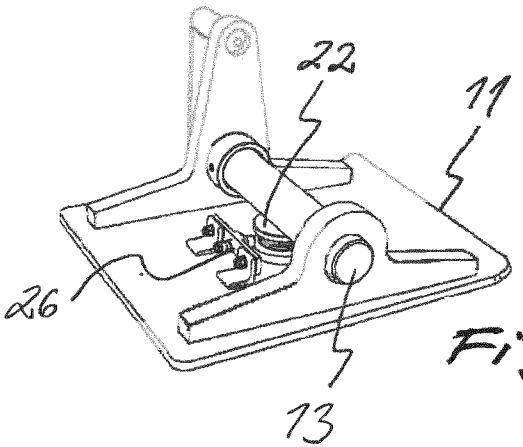

A slightly modified version of the beam assembly 8 is shown in FIGS. 13-19. Reference numerals that are the same as in FIGS. 3-7 are used in FIGS. 13-19 as well. In order to obtain a suitable pressure or load on the foot 11 of the beam assembly leg 10, a force or pressure sensing device is arranged in connection with the foot 11. This sensing device includes an actuating member 22, 23 having an upper portion 22 in engagement with the pivot 13 of the foot 11, and a lower portion 23 projecting downwardly from the upper portion 22. As best seen in FIG. 15, a number of annular cup springs 25 surround the lower portion 22 of actuating member 22, 23. The cup springs 25 can be of the type referred to as Belleville washers. The downwardly projecting portion 23 is placed just above an opening 24 in the bottom plate of the foot 11. As best seen in FIGS. 17-19, there is a sensor 26 arranged in connection with the actuating member 22, 23 of the foot 11.

When the leg 10 of the beam assembly 8 is lowered into support against the ground G, the pivot 13 presses against the upper portion 22 of the actuating member 22, 23 which means that the downwardly projecting portion 23 is inserted in the opening 24 against the action of the cup springs 25. This movement is detected by the sensor 26 which is configured to send signals to control systems (not shown) ensuring that the correct pressure or load is put on the foot 11, and thereby on the leg 10 as well as the entire beam assembly 8. During lowering of the foot 11 towards the ground G, the sensing device 22-26 senses when the foot 11 gets into contact with the ground G and can send signals to the actuating cylinder 9 which controls the movements of the foot 11 via the assembly of links, legs and pivots 10-16. Hereby a smooth and safe abutment of the foot 11 on the ground G is achieved which results in a safe operation of the beam assembly 8.

Certain aspects and variants of the present disclosure are set forth in the following clauses numbered I-XV.

I. A beam assembly for a railway wagon is configured to carry semitrailers and the like, said railway wagon comprising a first bogie (3), a second bogie (4) and a load-carrying section (5) therebetween, and said beam assembly (8) being configured to be moved out from and back to the railway wagon. The beam assembly is characterized in that the beam assembly (8) comprises an actuator (9) configured to lower and raise a leg (10) arranged at an outer end of the beam assembly (8), wherein the actuator (9) is arranged substantially in parallel with a main extension of the beam assembly (8).

II. The beam assembly of clause 1, wherein said actuator comprises a hydraulic cylinder (9).

III. The beam assembly of clause 1 or 2, wherein the leg (10) has a foot (11) at its free end.

IV. The beam assembly of any one of the clauses I-III, wherein the actuator (9) is connected to the leg (10) at a first pivot (12) at a first end of the leg (10).

V. The beam assembly of clause IV, wherein the first end of the leg (10) is placed at a sliding member (8A) which is moveable along a rail (8B) mounted substantially in parallel with said main extension of the beam assembly (8).

VI. The beam assembly of clause IV or V, wherein the foot (11) is connected to the leg (10) at a second pivot (13) at a second end of the leg (10).

VII. The beam assembly of any one of the clauses I-VI, wherein a link (14) is connected between an outer end of the beam assembly (8) and the leg (10), and wherein the link (14) is connected to the leg (10) at a point at a distance from the first and second ends of the leg (10).

VIII. The beam assembly of clause VII, wherein the link (14) is connected to the beam (8) at a third pivot (15) and to the leg (10) at a fourth pivot (16).

IX. A railway wagon comprises a first bogie (3), a second bogie (4) and a load-carrying section (5) therebetween. The railway wagon is characterized in that it has a beam assembly (8) as set forth in any one of the clauses I-XIII.

X. The railway wagon of clause IX, further comprising a channel (17) for conduits extending between the first bogie (3) and the second bogie (4).

XI. The railway wagon of clause X, wherein the channel (17) is configured to be automatically lowered in a mechanical way when the load-carrying section (5) is turned out.

XII. The railway wagon of clause X, wherein one end of the channel (17) is received moveable on a bar (18) having a sloping part (19).

XIII. The railway wagon of clause XII, wherein a roller (17A) of the channel (17) is received on the bar (18).

XIV. The railway wagon of any one of the clauses IX-XIII, wherein a slide (20) of a king pin locking system is arranged moveable by means of two cylinders (20A).

XV. The railway wagon of claim XIV, wherein the two cylinders (20A) are connected to a reservoir via a spring-loaded valve to act as dampers.

It should be mentioned that the inventive concept is by no means limited to the embodiments described herein, and modifications are feasible within the scope defined by the appended claims.

For instance, the improved railway wagon can be used for transportation not only of semitrailers, but also tractors, haulers and the like.

Furthermore, the movement of the beam assembly out from the wagon body to its active position can be performed in different ways.

One option is to mount the beam assembly turnable or pivotable about a vertical pivot provided on the wagon.

Another option is to arrange the beam assembly slideable in a direction substantially transverse the longitudinal axis of the wagon (the beam is slided out to its active position).

Finally, it should be noted that the actuator of the beam assembly can be of different design. As an alternative to the hydraulic cylinder described above, the actuator can also be pneumatically or electro-mechanically operated.

The invention claimed is:

1. A railway wagon configured to carry at least one vehicle, said railway wagon comprising a first bogie, a second bogie and a carrying section; said carrying section being movable between a first position in which it extends between said bogies, and a second position in which the carrying section is turned out from the railway wagon for loading and unloading of the at least one vehicle; wherein said railway wagon further comprises a channel for conduits extending between the first bogie and the second bogie; said channel being configured to be automatically lowered in a mechanical way when the carrying section is turned out to said second position.

2. The railway wagon as claimed in claim 1, wherein one end portion of the channel is movably received on a bar having a sloping part.

3. The railway wagon as claimed in claim 2, wherein a roller of the channel is received on the bar.

4. The railway wagon as claimed in claim 1, wherein the channel is arranged beneath said carrying section.

5. The railway wagon as claimed in claim 1, further comprising a beam assembly which is configured to be moved out from and back to the railway wagon while supporting a front portion of the carrying section.

6. The railway wagon as claimed in claim 5, wherein the beam assembly comprises a leg which is arranged at an outer end portion of the beam assembly and which is configured to support against the ground.

7. The railway wagon as claimed in claim 6, wherein the beam assembly comprises an actuator configured to lower and raise said leg.

8. The railway wagon as claimed in claim 7, wherein the actuator is arranged substantially in parallel with a main extension of the beam assembly.

9. The railway wagon as claimed in claim 6, wherein the leg has a foot at its free end, said foot being configured to abut the ground, and wherein said leg comprises a sensor device-configured to provide safe abutment of the foot on the ground.

10. The railway wagon as claimed in claim 7, wherein the actuator is connected to the leg at a first pivot at a first end of the leg.

11. The railway wagon as claimed in claim 9, wherein the foot is connected to the leg at a second pivot at a second end of the leg.

12. The railway wagon as claimed in claim 10, wherein said first end of the leg is placed at a sliding member which is moveable along a rail mounted substantially in parallel with the beam assembly.

13. The railway wagon as claimed in claim 6, wherein a link is connected between an outer end of the beam assembly and the leg, and wherein the link is connected to the leg at a point at a distance from first and second ends of the leg.

14. The railway wagon as claimed in claim 13, wherein the link is connected to the beam assembly at a third pivot and to the leg at a fourth pivot.

15. The railway wagon as claimed in claim 1, further comprising means for lowering and raising a front portion of the carrying section.

16. The railway wagon of claim 1, further comprising a king pin locking system having a slide moveable by means of cylinders, said slide being moveable to catch a king pin, wherein the cylinders are connected to a reservoir via a spring-loaded valve to act as dampers.

17. The railway wagon of claim 1, wherein the at least one vehicle includes at least one of a semitrailer, a tractor, or a hauler.

18. A beam assembly for a railway wagon configured to carry one or more vehicles, said railway wagon comprising a first bogie, a second bogie and a load-carrying section therebetween, said beam assembly configured to be moved out from and back to the railway wagon, the beam assembly comprises an actuator configured to lower and raise a leg arranged at an outer end of the beam assembly, wherein the actuator is arranged substantially in parallel with a main extension of the beam assembly.

19. The beam assembly of claim 18, wherein the actuator is connected to the leg at a first pivot at a first end of the leg, wherein the first end of the leg is placed at a sliding member which is moveable along a rail mounted substantially in parallel with said main extension of the beam assembly.

20. The beam assembly of claim 19, wherein a foot is connected to the leg at a second pivot at a second end of the leg, wherein a link is connected between an outer end of the beam assembly and the leg, and wherein the link is connected to the leg at a point at a distance from the first and second ends of the leg, wherein the link is connected to the beam at a third pivot and to the leg at a fourth pivot.

* * * * *